United States Patent [19]

Nakata et al.

[11] 4,128,910

[45] Dec. 12, 1978

[54] TOOTHBRUSH

[75] Inventors: Yuichi Nakata, Chigasaki; Tadayoshi Murakami, Tokyo, both of Japan

[73] Assignee: Pigeon Kabushiki Kaisha, Tokyo, Japan

[21] Appl. No.: 793,804

[22] Filed: May 4, 1977

[30] Foreign Application Priority Data

Jul. 7, 1976 [JP] Japan ..... 51-89908[U]

[51] Int. Cl.[2] ..... A47L 13/14

[52] U.S. Cl. ..... 15/110; 15/167 R; 15/188

[58] Field of Search ..... 15/110, 167 R, 167 A, 15/188, 210; 128/62 A; 132/84 R

[56] References Cited

U.S. PATENT DOCUMENTS 2,171,591 9/1939 Minich ..... 15/188 X 2,476,201 7/1949 Ligoure ..... 15/110 X 2,545,814 3/1951 Kempster ..... 15/167 R

*Primary Examiner*—Leonard D. Christian

*Attorney, Agent, or Firm*—Ladas, Parry, Von Gehr, Goldsmith & Deschamps

[57] ABSTRACT

A toothbrush having a handle and a rubber-like brushing structure having a plurality of brushing projections and mounted on the forward part of the handle is further provided with a rigid frame member surrounding the side surface of the brushing structure and engaged with the latter in a projection-and-recess relation, the frame member being bonded to the handle for indirectly securing the brushing structure to the handle, and the "hardness" in operation of the toothbrush, i.e., the brushing projections, being adjusted by varying the height of the frame member measured perpendicularly to the lengthwise direction of the handle.

3 Claims, 15 Drawing Figures

TOOTHBRUSH

BACKGROUND OF THE INVENTION

This invention relates generally to implements for oral hygiene and more particularly to a toothbrush for infants and young children.

Toothbrushes for infants and young children known heretofore have merely been miniaturized versions of bristle-implanted toothbrushes for adults. Apparently not much thought has been given to the inmature structure of the milk (deciduous) teeth and fragile gums of infants, the only observable evidence of consideration being a decrease in the hardness of the bristles of these toothbrushes provided by making the bristles thinner. As a consequence, the use of these toothbrushes becomes an unpleasant, if not painful, drudge for a child. Such a child is in a period of growth in which he must acquire a positive habit of brushing his teeth, but, on the contrary, many children develop a hatred for it.

Furthermore, a child with milk teeth must strengthen his gums thereby to prepare for his future permanent teeth. However, for a child who is already being forced to brush his teeth reluctantly by using a bristle-implanted toothbrush, the additional requirement, after brushing his teeth, of massaging his gums with a rubber brush for gum massaging heretofore sold on the market becomes an almost unbearable agony. The natural tendency of a child being coerced to undergo this stress is to gradually become careless in his care of his teeth and gums, which will give rise to negative results contrary to the intended objects.

SUMMARY OF THE INVENTION

It is an object of the present invention to provide a toothbrush for infants and young children, the use of which is not unpleasant, whereby a positive habit of brushing teeth and massaging gums can be easily developed.

Another object of this invention is to provide a toothbrush for infants and young children which is capable of functioning doubly for cleaning teeth and for massaging gums.

Still another object of the invention is to provide a toothbrush for infants and young children wherein a structure with brushing projections used instead of implanted bristles is secured firmly to the handle of the toothbrush via a frame member, whereby any possibility of the structure with btushing projections (hereinafter referred to as brushing structure) dropping out of the handle is substantially eliminated.

A further object of the invention is to provide a toothbrush for infants and young children, wherein the above mentioned frame member is also capable of functioning, in its production stage, as a control means for the "hardness" of the brushing projections, whereby toothbrushes of different grades of hardness adapted for infants of different ages can be produced by simply varying the height of the frame member.

According to the present invention, there is provided a toothbrush for infants and young children, comprising a handle made of a hard and rigid material, a brushing structure made of a soft and flexible rubber-like material mounted on and in contact with the forward end of the handle on one side thereof, and a frame member made of a hard and rigid material surrounding the side surface of the brushing structure, the frame member and the brushing structure engaging each other in a projection-and-groove relation, the frame member being bonded onto the forward end surface of the handle, thereby fixing the brushing structure to that part of the handle, the height of the frame member being so selected that the reaction forces against compression and bending of the brushing struction, and therefore the hardness of the toothbrush, are adjusted to suitable values adapted for the imfants and young children of different ages.

The nature, utility, and further features of this invention will be more clearly apparent from the following detailed description with respect to preferred embodiments of the invention when read in conjunction with the accompanying drawings briefly described below, throughout which like parts are designated by like reference numerals.

BRIEF DESCRIPTION OF THE DRAWINGS

In the drawings, in which all figures are enlarged views.

DETAILED DESCRIPTION

Figure 1:
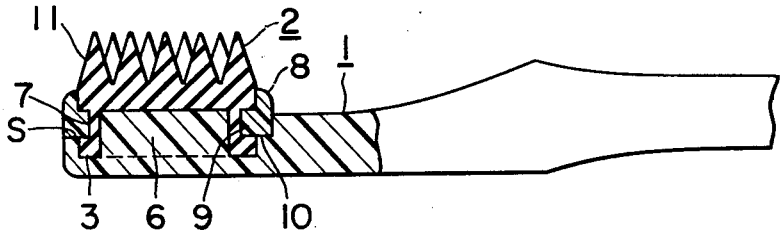
FIG. 1 is a side view of one example of a toothbrush according to this invention, with an important part of the toothbrush shown in longitudinal section.
Figure 2:
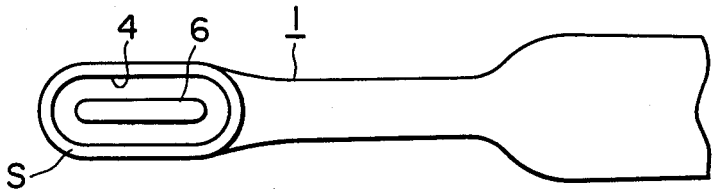
FIG. 2 is a plan view showing the forward end of the handle of the example.
Figure 3:
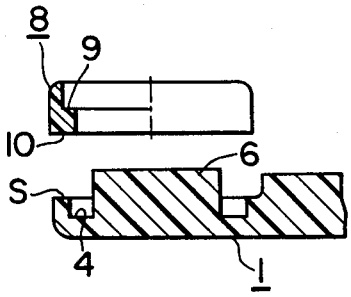
FIG. 3 is a side view showing a frame member and the forward part of the handle of the first example in a disassembled state, the front half of the frame member and the forward part of handle being in longitudinal section.
Figure 4:
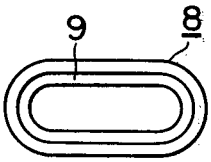
FIG. 4 is a plan view of the frame member in the same example.
Figure 5:
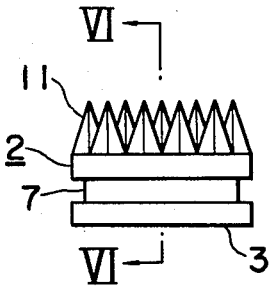
FIG. 5 is a side view of the brushing structure in this example.
Figure 6:
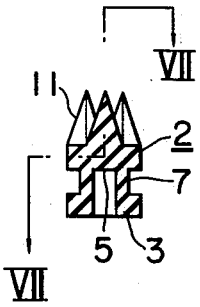
FIG. 6 is a sectional view taken along the line VI—VI in FIG. 5.
Figure 7:
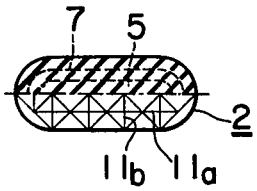
FIG. 7 is a sectional view taken along the line VII—VII in FIG. 6 as viewed in the arrow direction.

Referring now to FIGS. 1 through 7, there is shown a toothbrush constituting a first embodiment of the present invention. This toothbrush comprises a handle 1 made of a rigid resin such as an acrylonitrile-styrene copolymer, a brushing structure 2 made of a natural-rubber-like synthetic rubber such as cis-1,4-polyisoprene, and a frame member 8 described hereinafter.

The brushing structure 2 has an anchoring part 3 of an oval shape at its bottom, which is inserted into a groove 4 of a mating shape formed in and on one (top) side of the forward end of the handle 1, and a core groove 5 formed internally of the anchoring part 3. On the other hand, the handle 1 has a core projection 6 formed internally of the oval-shaped groove 4 and having a shape such that it can fit into the core groove 5 of the brushing structure 2 in a tight fit when the anchoring part 3 of the brushing structure 2 is inserted into the oval-shaped groove 4 of the handle 1. Furthermore, a peripheral groove 7 is formed around the outer surface of the brushing structure 2 at a position slightly above the anchoring part 3, as viewed in FIG. 1, so that the inner surface of the lower side wall of the peripheral groove 7 is in a plane coincident with the plane of a bonding surface S of the handle 1 (described hereinafter in detail) when the anchoring part 3 is inserted into the annular groove 4 of the handle 1.

Into the aforementioned groove 7 of the brushing structure 2, an inwardly projecting flange part 9 of the aforementioned frame member 8, which is provided to surround the brushing structure 2, is inserted in a projection-and-recess engagement. The frame member 8 is made of a rigid resin such as an acrylonitrile-styrene copolymer similar to that of the handle 1. After the frame member 8 has been thus assembled with the brushing structure 2, the anchoring part 3 of the brushing structure 2 is inserted into the oval-shaped groove 4 of the handle 1 as described hereinbefore, and the bottom surface of the frame member 8 is heat fused to the bonding surface S of the handle 1 by the application of supersonic waves or by the use of a bonding agent not harmful to the human body.

Figure 8:
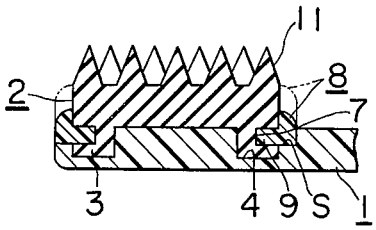
FIG. 8 is a side view, in longitudinal section, of the important part shown in FIG. 1, explanatory of the effect of the height of the frame member.

At this time, the frame member 8 is in contact with the side surface of the brushing structure 2, thus making it possible, in its production stage, to adjust the reaction forces against compression and bending of the brushing structure 2 to suitable values by selecting suitably the height of the frame member 8 or the height of the exposed part of the brushing structure 2 as indicated by full line and chain line in FIG. 8, whereby toothbrushes having various degrees of hardness can be thereby obtained regardless of the use of identical brushing structures of the same construction and material.

In the first embodiment of the present invention as described hereinabove, the brushing structure 2 has three longitudinal rows of pyramid-shaped projections 11, one at the center and two on both sides, among which those in the side rows are displaced in a staggered manner by ½ pitch from those in the central row. Each of the pyramid-shaped projections 11 has longitudinally disposed ridgelines 11*a* and transversely disposed ridgelines 11*b*. The above described arrangement of the projections 11 is effective in eliminating any remnant food particles lodging in the projections. Thus the toothbrush having the projections 11 is highly effective in both cleaning the teeth and in massaging the gums of infants and young children.

Since the toothbrush according to this invention has a construction as described above, wherein the brushing structure 2 is secured indirectly to the brush handle 1 through the frame member 8, the projections 11 can be moved with a degree of freedom although the brushing structure 2 is secured to the handle 1 in a clamped manner. Thus, a substantially uniform distribution of the reaction forces against compression and bending of the projections 11 is obtained, and when the projections 11 contact the teeth and gums of the infants with a hardness adjusted by the height of the frame member 8, cleaning of their teeth and massaging of their gums can be accomplished without damaging the teeth and gums.

Figure 9:
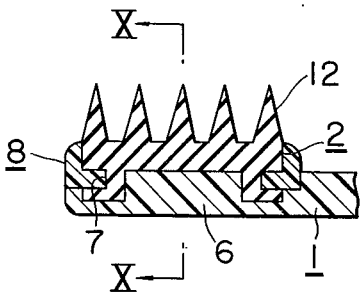
FIGS. 9, 10 and 11 are a side view in longitudinal section, a cross-sectional view taken along the line X—X in FIG. 9, and a perspective view, respectively, of the forward part of another example of a toothbrush constituting a second embodiment of the present invention.
Figure 10:
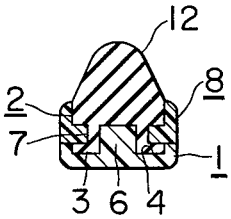
Figure 11:
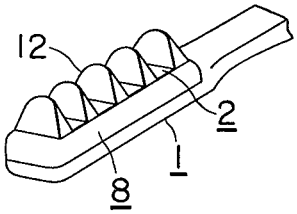

In FIGS. 9, 10, and 11, there is illustrated a second embodiment of the invention which is different from the first embodiment in that the brushing projection 2 has laterally extending fin-shaped projections 12, having a tapering tips, and disposed in spaced-apart arrangement in the longitudinal direction of the toothbrush.

Figure 12:
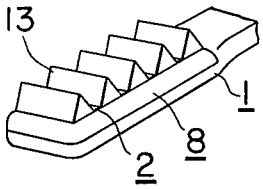
FIG. 12 is a perspective view of the forward part in a third embodiment of the invention.

In FIG. 12, there is shown a third embodiment of the invention wherein laterally extending projections 13 of triangular cross-section and disposed in spaced-apart arrangement in the longitudinal direction of the toothbrush are used instead of the projections 12 in the second embodiment.

Figure 13:
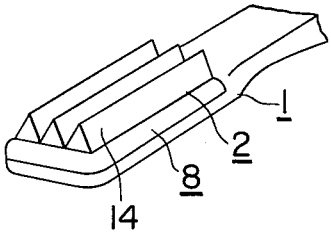
FIG. 13 is a perspective view of the forward part in a fourth embodiment of the invention.

In a fourth embodiment of the invention shown in FIG. 13, longitudinally extending projections 14 of triangular cross-section disposed side-by-side are used instead of the transverse projections 13 in the third embodiment.

Figure 14:
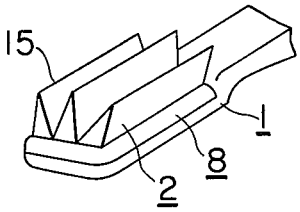
FIG. 14 is a perspective view of the forward part in a fifth embodiment of the invention.

A fifth embodiment of the invention shown in FIG. 14 includes longitudinally extending projections 15 which are similar to those in the fourth embodiment but differ in that the projection on the right side and the projection on the left side are tilted divergently outwardly, whereby their ridgelines at their tops are separated rightward and leftward from that of the central projection.

Figure 15:
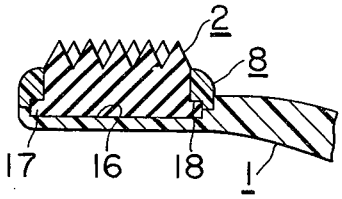
FIG. 15 is a side view, in longitudinal section, showing another type of engagement between the brushing structure and the frame member.

Although each of the embodiments of the invention described hereinabove has a brushing structure 2 and a frame member 8 joined together in a projection-and-recess manner as described in conjunction with the first embodiment, the engagement between the structure 2 and the frame member 8 may also be modified as shown in FIG. 15. In this construction, a comparatively wide recess 16 is provided in the forward end part of the handle 1, and a brushing structure 2 having a lower part formed into an outwardly, projecting flange 17 is inserted into the recess 16. A frame member 8 of the same configuration as described above except that a peripheral recess 18 is formed, instead of the flange part 9, along the inner lower periphery of the frame member 8 is placed around the brushing structure 2, and the contacting surfaces of the frame member 8 and the handle 1 may be bonded together with the use of a bonding agent.

We claim:

1. A toothbrush for infants and young children, which comprises a rigid handle having one end for attachment of a brush structure thereto and defining a recess to the one end, a brush structure having a plurality of projections extending substantially parallel to one another, made of a soft resilient rubber-like material and attached to one end of the handle with the projections projecting therefrom, and a rigid frame member fixedly located in the recess and defining an opening supporting the periphery of brush structure adjacent the one end of the handle to an extent to provide a desired restraint against bending of the projections, thereby to provide the brush structure with a desired stiffness wherein said brush structure has an anchoring part, and a core groove formed internally of the anchoring part, and said handle is formed on a surface at the forward end thereof with a groove for receiving the anchoring part and a core projection to be inserted into the core groove in the brush structure.

2. A toothbrush as claimed in claim 1 wherein a peripheral groove is formed around the outer surface of the brush structure and the frame member has an inwardly projecting flange, located in this peripheral groove.

3. A toothbrush as claimed in claim 1 wherein said projections of the brush structure are three longitudinally extending projections disposed in side-by-side arrangement in the transverse direction of the toothbrush, each of the projections having a triangular cross-section, the right side projection and the left side projection having their top ridgelines deflected respectively rightwardly and leftwardly from that of the central projection.

* * * * *